United States Patent [19]

Fujie et al.

[11] 4,025,060

[45] May 24, 1977

[54] MOLTEN METAL POURING DEVICE

[75] Inventors: Masakatsu Fujie, Ushikumachi; Hiroshi Yamamoto, Shimoinayoshi; Atsushi Matsuzaki, Tokyo, all of Japan

[73] Assignee: Hitachi, Ltd., Japan

[22] Filed: Sept. 8, 1976

[21] Appl. No.: 721,411

[30] Foreign Application Priority Data

Sept. 22, 1975 Japan ..... 50-113676

[52] U.S. Cl. ..... 266/240; 164/335; 266/91; 222/164; 164/155

[51] Int. Cl.[2] ..... B67D 5/64

[58] Field of Search ..... 222/164, 604, 605; 266/91, 240; 164/155, 335

[56] References Cited

UNITED STATES PATENTS

| | | | |
|---|---|---|---|
| 898,631 | 9/1908 | Custer | 164/335 |
| 2,040,157 | 5/1936 | Story et al. | 222/166 |
| 2,683,295 | 7/1954 | Howlett et al. | 222/166 |
| 3,917,111 | 11/1975 | Berthet et al. | 266/91 |
| 3,923,201 | 12/1975 | Hersh et al. | 222/604 |

FOREIGN PATENTS OR APPLICATIONS

| | | | |
|---|---|---|---|
| 246,304 | 4/1912 | Germany | 266/166 |

*Primary Examiner*—Gerald A. Dost
*Attorney, Agent, or Firm*—Craig & Antonelli

[57] ABSTRACT

A molten metal pouring device is disclosed, wherein there are provided two pairs of link mechanisms whose links are adapted to be moved in parallel relation to each other, so that, regardless of an inclined angle of a ladle, a molten metal-dropping locus may follow a constant path when a molten metal is poured from a ladle into a mold. The molten metal pouring device equipped with these link mechanisms can be readily automated, as well as permits the reduction in cross sectional area of a sprue of a mold. Thus, temperature drop of a molten metal is avoided, with the result of production of castings of an improved quality.

5 Claims, 5 Drawing Figures

MOLTEN METAL POURING DEVICE

BACKGROUND OF THE INVENTION

This invention relates to a molten metal pouring device, wherein a molten metal-dropping locus may follow a constant path, when a molten metal is poured into a mold.

Where it is desired to pour a molten metal into a mold arranged on a casting line, it must be taken into consideration that a molten metal should accurately drop into a sprue of a mold. Generally speaking, a locus of a molten metal which is dropping from a beak of a ladle varies depending on a case where a large amount of molten metal is filled in a ladle or where only a small amount of molten metal is filled therein. It is a common practice that a variation in molten metal-dropping locus is compensated for by enlarging the cross sectional area of a sprue. Variation in molten metal-dropping locus, however, results in difficult in detecting a molten metal level in a sprue, and causes scattering of a molten metal to the exterior of the sprue, and hence damages on various kinks of instruments provided on the molten metal pouring device. An enlarged sprue is bound to an increase in amount of a molten metal dwelling in a sprue, and it takes a long time for such a large amount of a molten metal to flow into a cavity of a mold. In this case, the temperature of molten metal is lowered, and a smooth flow of molten metal can not be achieved, leading to degradation in quality of casting produced.

OBJECTS OF THE INVENTION

It is accordingly an object of the present invention to provide a molten metal pouring device, wherein, regardless of an inclined angle of a ladle, a molten metal-dropping locus may follow a constant path, so that the cross sectional area of a sprue in a mold may be reduced, and the pouring of molten metal into a mold may be readily automated.

It is another object of the present invention is to provide a molten metal pouring device, wherein the scattering of a molten metal over the surroundings of a mold may be avoided.

It is a further object of the present invention to provide a molten metal pouring device, wherein the cross sectional area of a sprue in a mold is reduced, thereby producing casting of an improved quality.

SUMMARY OF THE INVENTION

The molten metal pouring device according to the present invention is characterized in that there are provided two pairs of link mechanisms whose links are moved in parallel relation to each other, and a ladle is secured to the free ends of respective links of one pair of link mechanisms, said ladle being adapted to be turned about a point, at which an extension of a line connecting the free ends of respective links of the pairs of link mechanisms together intersects with an extension of a line connecting the other ends of the links mounted on supporting shafts together, whereby a molten metal dropping locus may follow a constant path, when a molten metal is poured, independently of inclinations of the ladle.

DESCRIPTION OF PREFERRED EMBODIMENTS

Figure 1:
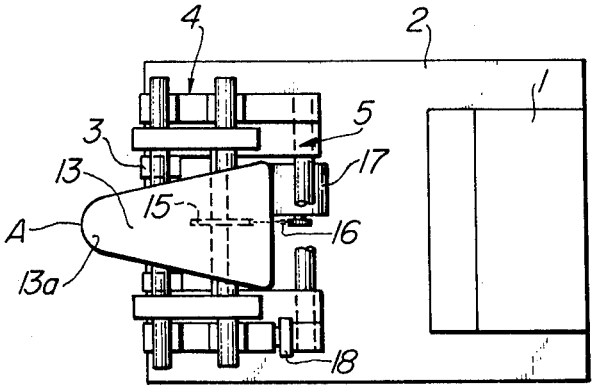
FIG. 1 is a plan view of the molten metal pouring device according to the present invention.
Figure 2:
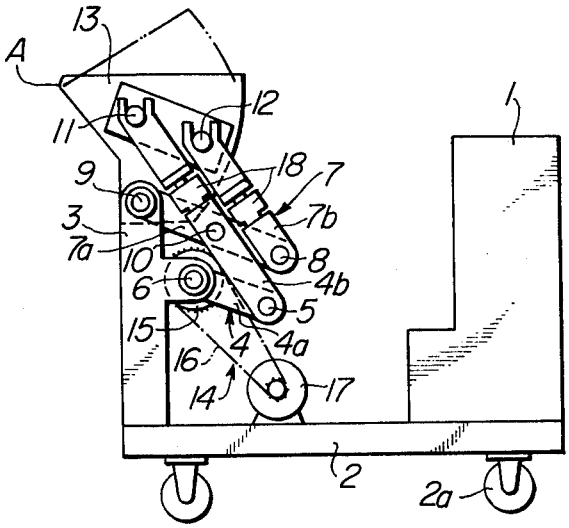
FIG. 2 is a side elevational view of the device.

Referring first to FIGS. 1 and 2 which show top and side views of the molten metal pouring device according to the present invention, a control device 1 is placed on a wheeled platform 2 and contains a hydraulic device. The wheeled platform 2 has wheels 2*a* so as to freely travel along a pair of rails. Posts 3 are rigid with the wheeled platform 2. A first pair of link mechanisms 4 are each composed of links 4*a* and 4*b*, one ends of which are mutually rotatably mounted on a supporting shaft 5. Each link 4*a* is journaled on a supporting shaft 6 at the other end, which link is supported on the post 3. A second pair of link mechanisms 7 are each composed of links 7*a* and 7*b*, one ends of which are mutually rotatably mounted on a supporting shaft 8. Each link 7*a* is journaled on a supporting shaft 9 at the other end, which link is supported on the post 3, as well. The links 4*b* and 7*a* are mutually rotatably supported on a supporting shaft 10 at their mid points. The links 4*b* and 7*b*, at their other ends, removably engage supporting shafts 11 and 12, which in turn are attached to a ladle 13. The links 4*a* of the first pair of link mechanisms 4 and the links 7*a* of the second pair of link mechanisms 7 are arranged in parallel relation to each other, and the links 4*b* of the first pair of link mechanisms 4 and the links 7*b* of the second pair of link mechanisms are arranged in parallel relation to each other. Shown at A is a point, at which an extension of a line connecting the free ends of the links 4*b* and 7*b* together, intersects with an extention of a line connecting the other ends of the links 4*a* and 7*b* together, which are supported on the posts. The ladle 13 is so arranged that a beak 13*a* of a ladle 13 thereof is located in accord with the intersection A. A link drive mechanism 14 is composed of a sprocket 15 mounted on the supporting shaft 6, a chain 16 and a drive motor 17. The drive motor 17 may be an electric motor, and should preferably be a hydraulic motor from the viewpoint of simplicity of construction. Load detecting means 18 are attached to the links 4*b* and 7*b*, respectively.

In operation, when the drive motor 17 is operated to rotate the links 4*a* of the first pair of link mechanisms 4 in the counterclockwise direction, then the links 7*a* of the second pair of link mechanisms 7 are rotated in the counterclockwise direction through the mediary of the links 4*b*. The rotation of these links 4*a* and 7*a* causes the links 4*b* and 7*b* to move in cooperation therewith, whereby the ladle 13 will be turned about the intersection A of the two extensions in the counterclockwise direction, to thereby assume a molten metal pouring position, as shown by a two-dotted line in FIG. 2.

So far as the sprue 13*a* of the ladle 13 is located in according with the intersection A, a molten metal drops from a beak 13*a* of the ladle 13 into a sprue of a mold, describing the constant locus, irrespective of an amount of a molten metal remaining in the ladle 13. This permits reduction in cross sectional area of the sprue.

The load detecting means 18 are useful for detecting an amount of a molten metal remaining in the ladle 13, and an amount of a molten metal in the ladle may be accurately detected, without a visual check of an operator.

Figure 3:
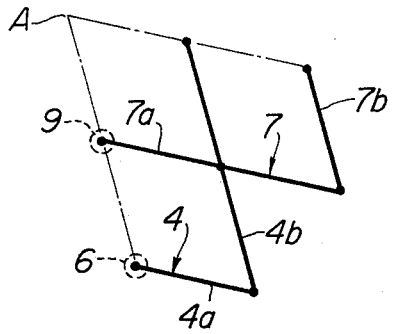
FIG. 3 is diagramatically shows link mechanisms of the device.

FIG. 3 diagramatically shows the link mechanisms of the molten metal pouring device shown in FIGS. 1 and 2. Since the construction is the same as the above-described, no further description is given.

When it is desired to pour a molten metal into a mold manually, the ladle 13 is demounted from the link mechanisms, and in turn, suspended by means of wires, with a handle attached to the ladle.

Figure 4:
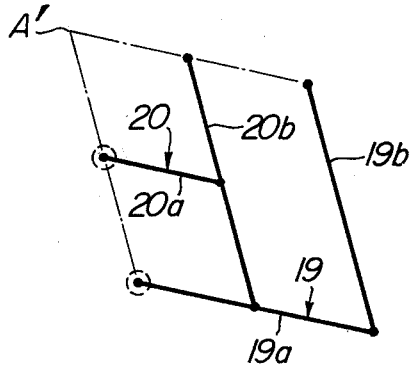
FIGS. 4 and 5 are modifications of the link mechanisms of the device, which are diagramatically shown for simplicity of explanation, respectively.

FIG. 4 diagramatically shows the link mechanisms in a modified form, wherein the first link mechanisms 19 are each composed of links 19*a* and 19*b*, and the second link mechanisms 20 are each composed of lines 20*a* and 20*b*. An extension of a line connecting those other ends of the links of the first and second link mechanisms 19 and 20, together, which ends are respectively supported on the posts, intersects at a point A′ with an extension of a line connecting one free ends of the links of respective link mechanisms together.

Figure 5:
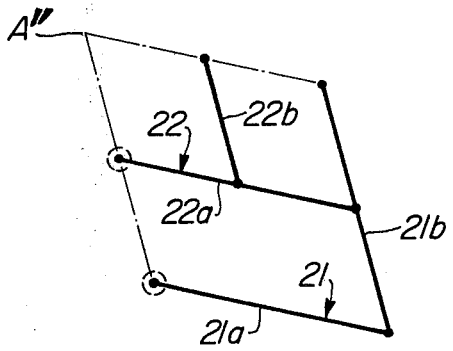

FIG. 5 diagramatically shows a further modification of the link mechanisms comprising of the first and second link mechanisms. The first link mechanisms 21 composed of links 21*a* and 21*b*, respectively, while the second link mechanisms 22 are composed of links 22*a* and 22*b*, respectively. An intersection which is obtained in like manner as in the former embodiment is indicated at A″.

According to the present invention, a molten metal is poured into a mold, describing a constant molten metal-dropping locus, independently of an amount of molten metal remaining in the ladle. This enables the pouring of a molten metal even into a reduced sectional area of a sprue in a mold, with the resultant easiness in control of a molten metal in a sprue in a mold as well as in detection for a level of a molten metal in the sprue.

The molten metal pouring device equipped with two pairs of link mechanisms, if employed, for example, on a casting line, enables the automatic pouring of an optimum amount of a moltent metal into molds arranged on a casting line, with the freedom of scattering of a molten metal over the surroundings of these molds, so that an intended automated molten metal pouring system may be achieved.

Furthermore, reduction in cross sectional area of a sprue of a mold may be achieved in the molten metal pouring device of the invention, thereby retarding lowering of a temperature of a molten metal, with the resultant smooth flow of a molten metal into a cavity in a mold. This insures production of casting of an improved quality.

What is claimed is:

1. In a molten metal pouring device, the improvements comprising;
   - two pairs of link mechanisms each having a pair of links, respective links of said two pairs of link mechanisms being turned in parallel relation to each other;
   - a ladle rotatably mounted on one ends of respective links of one pair of link mechanisms; and
   - posts for supporting the other ends of said respective links;
   - said ladle being arranged, in a manner to position its beak in accord with a point, at which an extension of a line connecting one ends of respective links together intersects with an extension of a line connecting the other ends of respective links, together.

2. The improvements as defined in claim 1, wherein posts are fixed on a wheeled platform which is free to travel.

3. The improvements as defined in claim 2, wherein said ladle is removably mounted on said links.

4. The improvements as defined in claim 3, wherein said pairs of link mechanisms are driven by a hydraulic motor.

5. The improvements as defined in claim 4, wherein load detecting means are provided on said links, respectively.

* * * * *